US005444522A

United States Patent [19]

Owens, Jr.

[11] Patent Number: 5,444,522

[45] Date of Patent: Aug. 22, 1995

[54] REPLACEABLE CLEANER SUBSYSTEM THAT PREVENTS PARTICLE SPILLAGE

[75] Inventor: Alvin J. Owens, Jr., Fairport, N.Y.

[73] Assignee: Xerox Corporation, Stamford, Conn.

[21] Appl. No.: 229,942

[22] Filed: Apr. 18, 1994

[51] Int. Cl.[6] ..... G03G 21/00

[52] U.S. Cl. ..... 355/296; 355/297; 118/652

[58] Field of Search ..... 355/296, 297, 298, 299, 355/301; 118/652; 101/425

[56] References Cited

U.S. PATENT DOCUMENTS

| | | | |
|---|---|---|---|
| 4,192,231 | 3/1980 | Kawakami | 101/425 |
| 4,764,790 | 8/1988 | Watashi | 355/15 |
| 4,791,454 | 12/1988 | Takahashi et al. . | |
| 4,819,030 | 4/1989 | Shibano | 355/15 |
| 4,849,791 | 7/1989 | Hagihara et al. | 355/298 |
| 4,866,482 | 9/1989 | Hirasawa et al. | 355/260 |
| 5,266,998 | 11/1993 | Lee | 355/210 |
| 5,341,200 | 8/1994 | Thomas | 355/298 |

*Primary Examiner*—R. L. Moses
*Attorney, Agent, or Firm*—T. Fair

[57] ABSTRACT

An apparatus and method for removing the customer replaceable cleaner subsystem from the electrostatographic machine without spillage of toner and other debris particles. The cleaning subsystem is a hybrid of a disturber brush and a retractable cleaning blade. The cleaning unit is slidably inserted or removed from the machine. The cleaning unit is removed from the machine when a cleaning failure occurs and replaced by a readily available spare cleaning unit. When the cleaning unit is inserted into the machine, adjacent to the photoreceptor, the door panel is slidably opened as the cleaning unit is moved into the appropriate space. The blade is moved into an engaged position with the photoreceptor for cleaning. When the cleaning unit is removed from the printer machine, the blade is retracted and the door panel is slidably closed as the cleaning unit is being removed, providing self-sealing of the cleaner unit and preventing toner and other debris spillage.

26 Claims, 4 Drawing Sheets

REPLACEABLE CLEANER SUBSYSTEM THAT PREVENTS PARTICLE SPILLAGE

BACKGROUND OF THE INVENTION

This invention relates generally to a cleaning apparatus, and more particularly concerns a customer replaceable hybrid cleaner.

Xerographic cleaning subsystems of low to mid volume copiers often use blade cleaning to remove toner from the photoreceptor (i.e. imaging surface). In a hybrid cleaner configuration, a brush disturber loosens and removes some particle contaminants from the photoreceptor, providing cleaning of the surface. This brush is followed by a cleaning blade that acts as the primary cleaner of the contaminants from the surface. At times, premature cleaning failures occur to the cleaning blade due to wear, nicks, carrier beads, paper fibers, and other contaminants. Such failures in xerographic cleaners require the replacement of the cleaning blade.

Normally, replacement of a failed blade in a hybrid system requires the services of a technical representative. The use of a technical representative causes the customer to experience significant downtime while awaiting replacement of the cleaning blade.

The following disclosures may be relevant to various aspects of the present invention and may be briefly summarized as follows:

U.S. Pat. No. 4,819,030 to Shibano discloses a cleaning device adapted to be detachably mounted on an electrostatic printing apparatus for removing extra toner left on a photosensitive member of the printing apparatus for storage in a toner recovery tank is disclosed. The cleaning blade is used to seal an opening of the toner recovery tank when the cleaning device is detached from the photosensitive member.

U.S. Pat. No. 4,764,790 to Watashi discloses the elimination of the possibility of mixing of the color of a previously used toner into a toner image after replacement of a developing unit by another unit containing a different color of toner.

SUMMARY OF INVENTION

Briefly stated, and in accordance with one aspect of the present invention, there is provided a printing apparatus having a cleaner subsystem for removing particles from a surface. The printing apparatus comprises means for cleaning the particles from the surface. A housing defines an open ended chamber. The cleaning means is mounted in the chamber of the housing with a portion thereof being adapted to extend from the open ended chamber into contact with the surface. A cover is mounted movably on the housing and adapted to move between a position closing the open ended chamber to a position opening the open ended chamber in response to the cleaner subsystem being inserted into the printing apparatus.

Pursuant to another aspect of the present invention, there is provided a method of installing a cleaner subsystem adjacent to a surface, of a printing machine. This method comprises the steps of: inserting the cleaner subsystem into the printing machine; and opening a chamber of the cleaner subsystem, in response to the cleaner subsystem being inserted into the printing machine to enable a cleaning member to extend from the chamber into contact with the surface.

Pursuant to another aspect of the present invention there is provided an operator replaceable cleaning unit adapted to remove particles from a surface of a printing machine. The cleaning unit comprises a device for cleaning the particles from the surface. A housing defines an open ended chamber. The cleaning device is mounted in the chamber of the housing with a portion thereof being adapted to extend from the open ended chamber into contact with the surface. A cover is mounted movably on the housing and adapted to move between a position closing the open ended chamber to a position opening the open ended chamber in response to the cleaning unit being inserted into the printing machine.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 5:
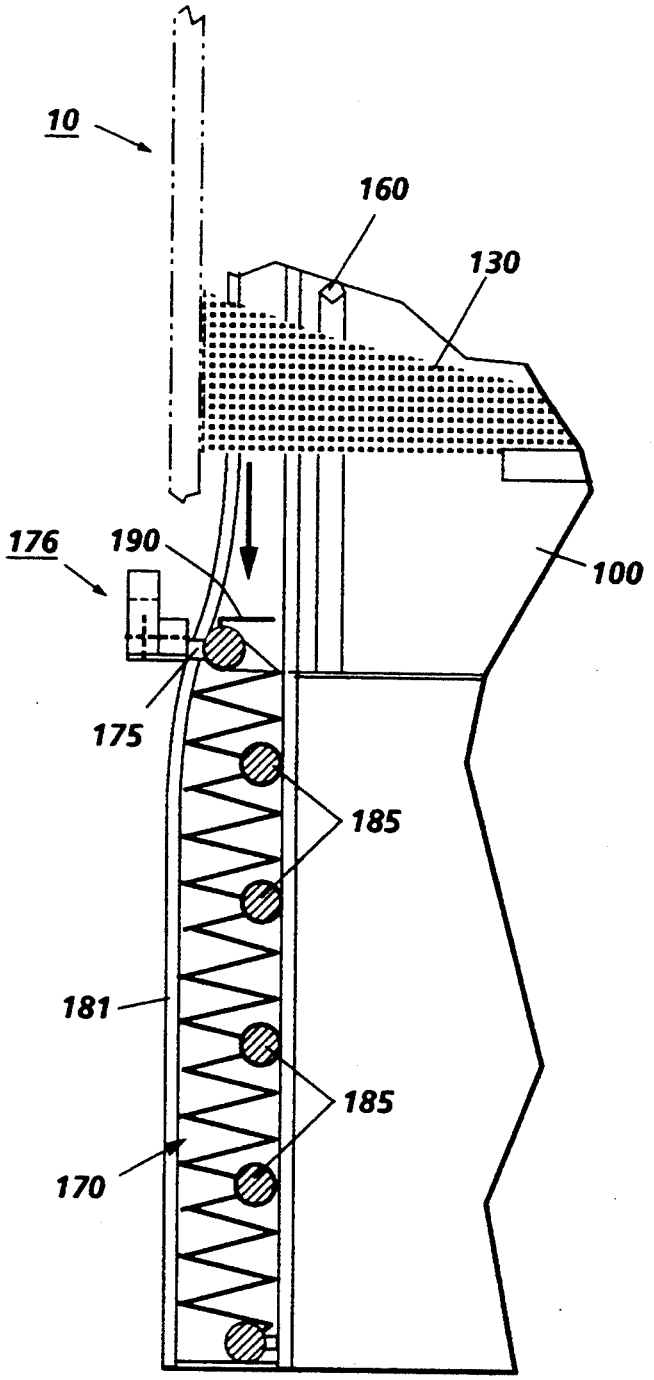
FIG. 5 is a top partial breakaway of the collection of the door panel when open.

For a general understanding of an electrostatographic printer or copier in which the present invention may be incorporated, reference is made to FIG. 5, which depicts schematically the various components, thereof. Hereinafter, like reference numerals will be employed throughout to designate identical elements. Although the flexible conductive cleaner brush apparatus of the present invention is particularly well adapted for use in an electrostatographic printing machine, it should become evident from the following discussion, that it is equally well suited for use in other applications and is not necessarily limited to the particular embodiment shown herein.

Referring now to the drawings, the various processing stations employed in the reproduction machine illustrated in FIG. 6, will be described briefly hereinafter. It will no doubt be appreciated that the various processing elements also find advantageous use in electrostatographic printing applications from an electronically stored original, and with appropriate modifications, to an ion which deposits ions and image configuration on a charge retentive surface.

A reproduction machine, in which the present invention finds advantageous use, has a photoreceptor belt 10, having a charge retentive (or imaging) surface 11. The photoreceptor belt 10 moves in the direction of arrow 12 to advance excessive portions of the belt 10 sequentially through the various processing stations disposed about the path of movement thereof. The belt 10 is entrained about a drive roller 14, tension rollers 16, 17 and stripping roller 20. Drive roller 14 is coupled to a motor 21 by suitable means such as a belt drive. The belt 10 is maintained in tension by a pair of springs (not shown) resiliently urging tension roller 16 against the belt 10 with the desired spring force. Stripping roller 20 and tension rollers 16, 17 are rotatably mounted. These rollers are idlers which rotate freely as the belt 10 moves in the direction of arrow 12.

Figure 6:
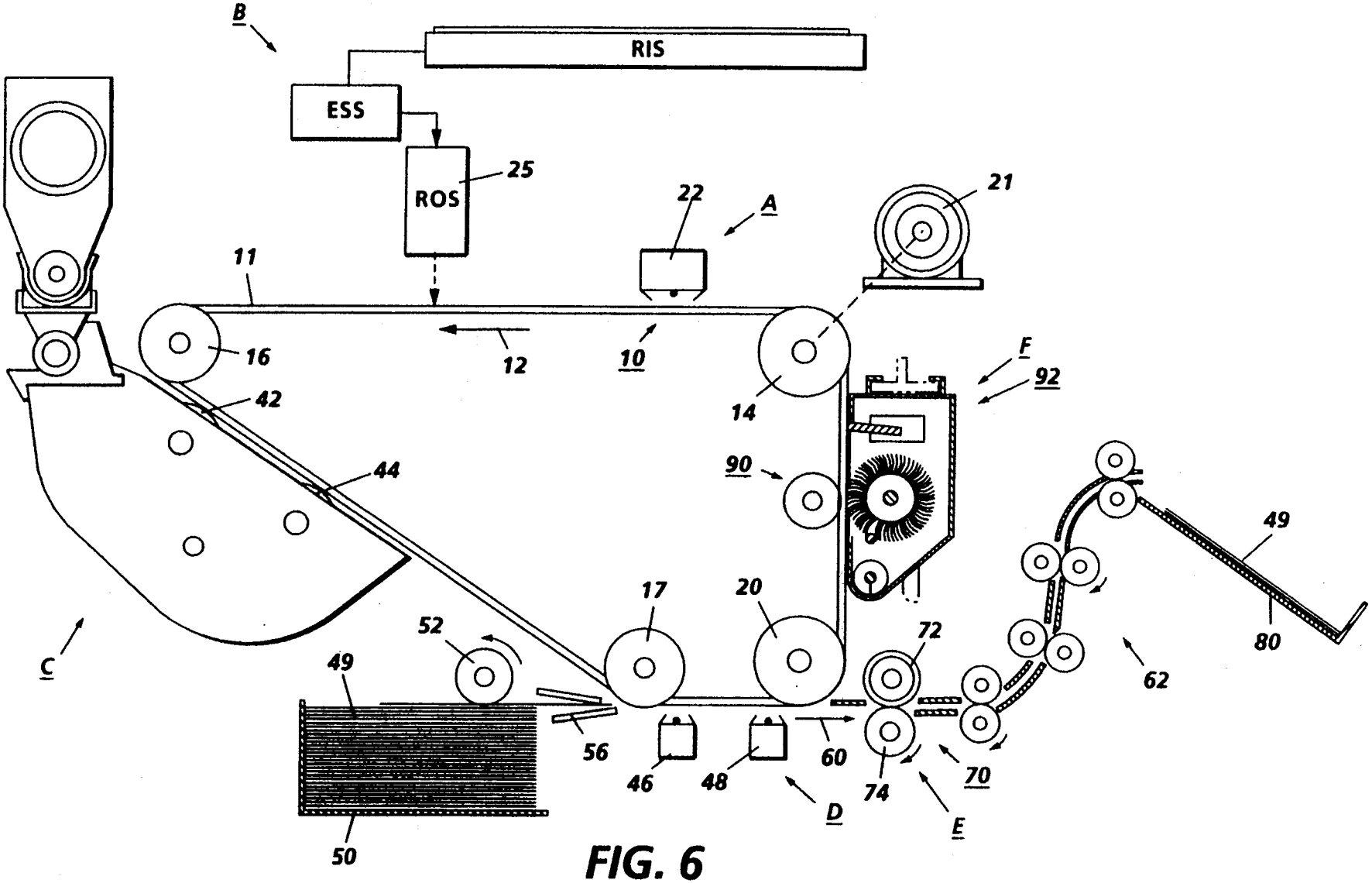
FIG. 6 is a schematic illustration of a printing apparatus incorporating the inventive features of the present invention..

With continued reference to FIG. 6, initially a portion of the belt 10 passes through charging station A. At charging station A, a corona device 22 charges a portion of the photoreceptor belt 10 to a relatively high, substantially uniform potential, either positive or negative.

At exposure station B, a laser may be provided to imagewise discharge the photoreceptor in accordance with stored electronic information. The uniformly charged photoreceptor or charged retentive surface 11 is exposed to a laser based input and/or output device 25 which causes the charge retentive surface to be discharged in accordance with the output from the scanning device. Preferably the scanning device is a three level Raster Output Scanner (ROS). Alternatively, an original document may be positioned face down on a transparent platen for illumination with flash lamps. Light rays are then reflected from the original document through a lens and projected onto a charged portion of the photoreceptor belt 10 to selectively dissipate the charge thereon. This would record an electrostatic latent image on the belt which corresponds to the informational area contained within the original document.

Thereafter, the belt 10 advances the electrostatic latent image to develop station C. At development station C, developer housings are brought into contact with the belt 10 for the purpose of developing the electrostatic latent image. One or more developer housings may be moved into and out of developing position with corresponding cams, which are selectively driven by a motor. In the instance where two developer colors are required, each developer housing supports a developing system such as magnetic brush rolls 42 and 44, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10. If two colors of developer material are not required, the second developer housing may be omitted.

The photoreceptor belt 10 then advances the developed latent image to transfer station D. At transfer station D, a sheet of support material such as paper copy sheets is advanced into contact with the developed latent images on the belt 10. A corona generating device 46 charges the copy sheet to the proper potential so that it becomes tacked to the photoreceptor belt 10 and the toner powder image is attracted from the photoreceptor belt 10 to the sheet. After transfer, the corona generator 48 charges the copy sheet to an opposite polarity to detack the copy sheet from the belt 10, whereupon the sheet is stripped from the belt 10 at stripping roller 14.

Sheets of support material 49 are advanced to transfer station D from a supply tray 50. Sheets are fed from tray 50, with sheet feeder 52, and advanced to transfer station D along conveyor 56.

After transfer, the sheet continues to move in the direction of arrow 60 to fusing station E. Fusing station E includes a fuser assembly indicated generally by the reference numeral 70, which permanently affixes the transfer toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a chute 62 to an output 80 or finisher.

Residual particles, remaining on the photoreceptor belt 10 after each copy is made, may be removed at cleaning station F. The cleaning apparatus of the present invention is represented by the reference numeral 92 which will be described in greater detail in FIGS. 1–4. Removed residual particles may also be stored for disposal. A backup roll 90 is provided as support to the photoreceptor belt 10 during the cleaning phase of the xerographic process.

A machine controller (not shown), preferably a known programmable controller or combination of controllers, conventionally control all the machine steps and functions described above.

As thus described, a reproduction machine, in accordance with the present invention may be any of several well known devices. Variations may be expected in specific electrostatographic processing, paper handling and control arrangements without effecting the present invention. However, it is believed that the foregoing description is sufficient for purposes of the present application to illustrate the general operation of an electrostatographic printing machine which exemplifies one type of apparatus employing the present invention therein.

Figure 1:
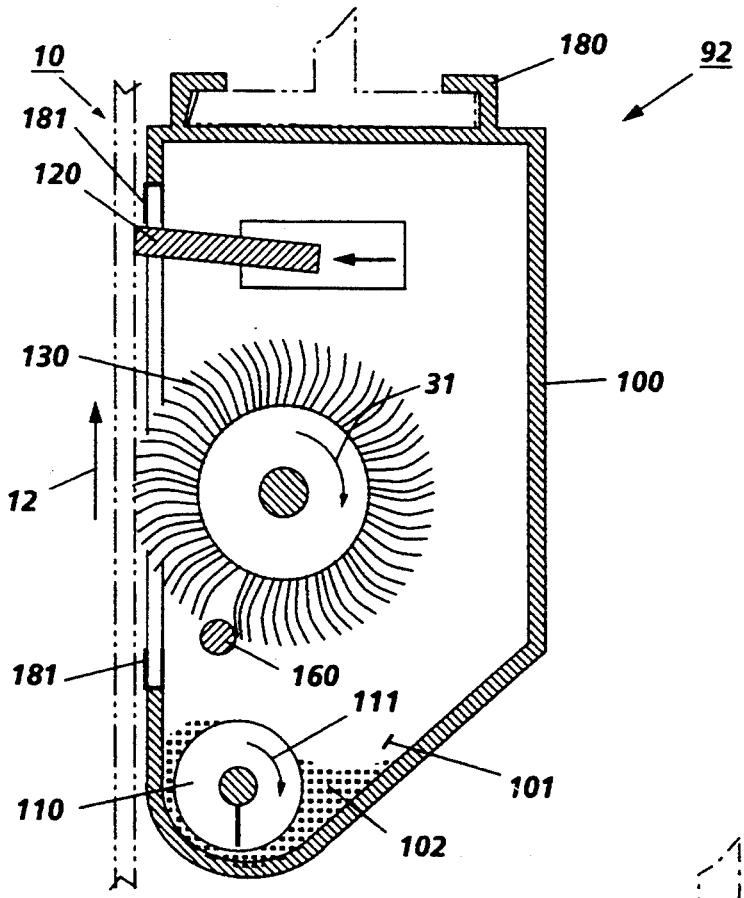
FIG. 1 is an elevational view of the cleaning subsystem with the door panel open.
Figure 3:
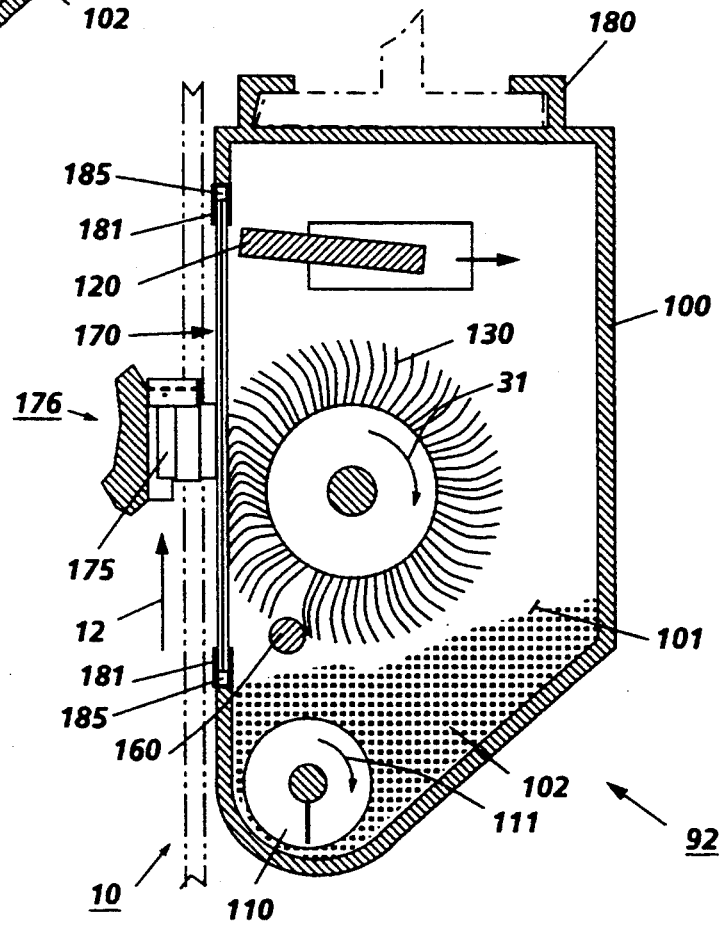
FIG. 3 is an elevational view of the cleaning subsystem with the door panel closed.
Figure 4:
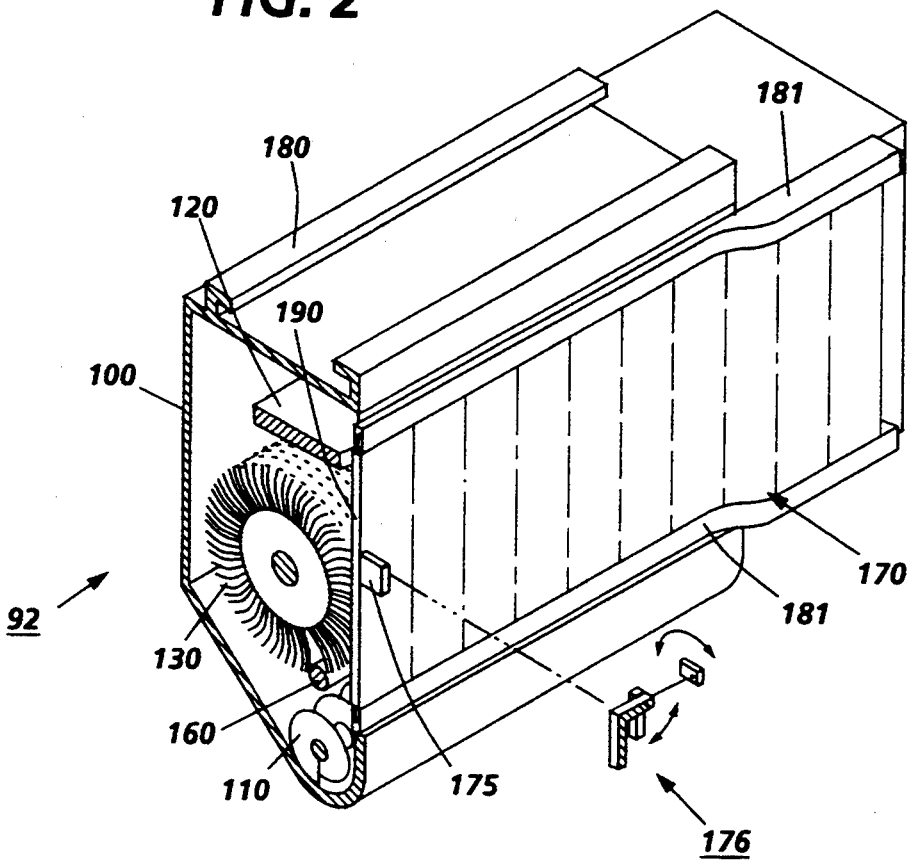
FIG. 4 is a perspective view of the cleaning subsystem with the door panel closed.

Reference is made to FIG. 1, which shows an elevational view of the replaceable hybrid (e.g. brush/blade) cleaning subsystem with the door panel open. The particles are cleaned from the photoreceptor belt 10 by the cleaning subsystem 92. The cleaning subsystem has a disturber brush 130, for loosening particles on the imaging surface of the photoreceptor 10 (i.e. drum or belt) followed by a retractable blade 120, that acts as the primary cleaner of the imaging surface. The blade is in contact with the photoreceptor surface when the panel door of the housing is open as in FIGS. 1 and 2. The blade 120 is retracted away from the surface when the door is closed as shown in FIGS. 3 and 4 for removal from the electrostatographic machine. A flicker bar 160 is used to detone the brush 130 of particles picked up by the brush 130 during cleaning of the imaging surface. The brush 130 rotates in a clockwise direction, shown by arrow 31, in the with direction of movement of the photoreceptor direction.

With continued reference to FIG. 1, the housing 100 provides a cavity 101 to collect the residual particles 102 (i.e. toner and other debris particles) removed from the surface and the brush. The residual particles 102 removed from the surface fall into the cavity 101 due to the force of gravity. An auger 110, rotating in a clockwise direction indicated by arrow 111, is located in the cavity 101 and transports the particles away from the cleaner housing to a waste collection bottle (not shown). This hybrid cleaning system positions the blade 120, behind the brush 130, in the direction of motion of the imaging surface (see arrow 12). The blade 120 shown in this figure operates in the wiping mode. However, the mode (i.e. wiping or doctoring) of the blade and the directions of rotation (e.g. of the brush and the auger) are variable.

Figure 2:
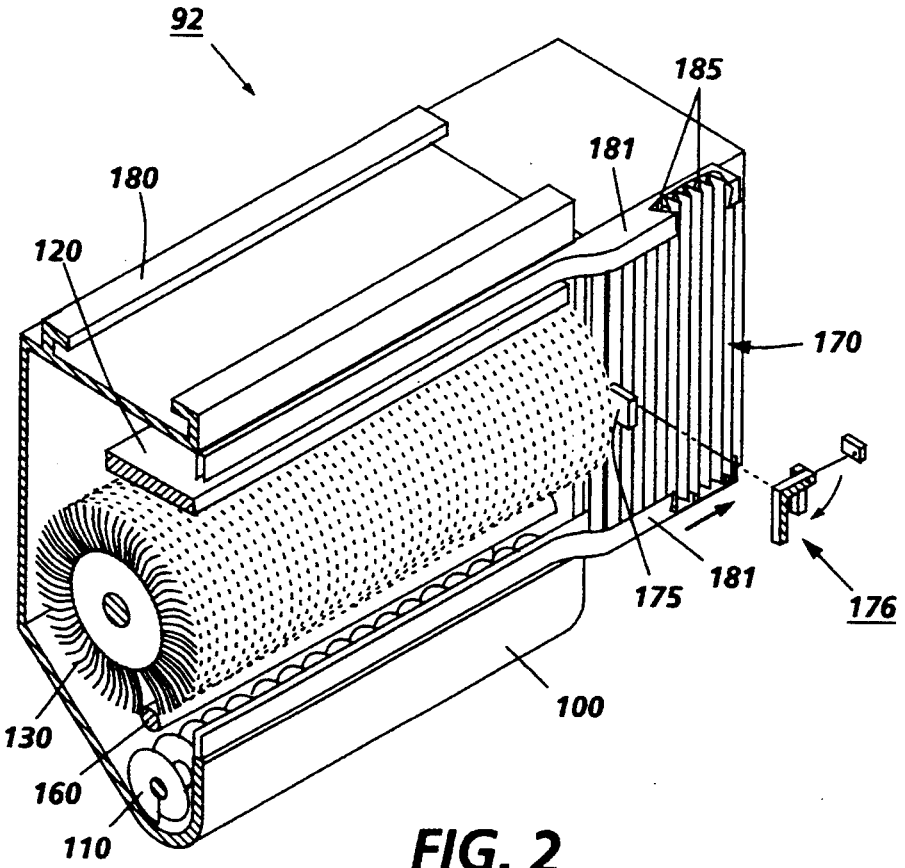
FIG. 2 is a perspective view of the cleaning subsystem with the door panel open.

FIG. 2 shows a perspective view of the customer replaceable unit (i.e. CRU) cleaning subsystem of FIG. 1. This view of the cleaner subsystem shows the door panel 170 open as it is when the subsystem is attached to the xerographic module. The protrusion of the handle 175 from the door panel 170, contacts the frame of the xerographic module which acts as a stop (i.e. the interference of the handle and the frame couples the handle to the frame) as the cleaner subsystem is pushed into it's predetermined place along the guide rail 180 of the housing and, the door panel 170 is forced open. This force causes the flexible door panel to fold like an accordion or a drawn curtain as the cleaner subsystem module is installed slidably into the xerographic cleaning area. The door panel as it is opened collects the folded portion in a widened area of the track 181 (see FIG. 5). (The widened area of the track 181 is shown broken away so that the collection of the folded door panel 170 can be seen.) As the door panel 170 is opened,the hybrid cleaner is exposed at the opening of the housing. The pliable brush fibers contact the photoreceptor surface as the door panel is opened. (The brush fibers pliability allow them to bend as the door panel is closed and to spring back in contact with the imaging surface when the door panel is opened). The retractable blade 120 is moved into contact with the photoreceptor surface once the cleaner subsystem is in place. The door handle 175 has a locking mechanism that holds the door panel 170 in the open position when the cleaner subsystem has been completely inserted into the xerographic module.

Referring now to FIG. 3, which shows an elevational view of the present invention with the door panel 170 closed. The door panel 170 when closed is used to confine and prevent spillage of toner and other particle debris from the housing 100 when the cleaner subsystem 92 is removed from the copier. The cleaner subsystem is removed, in the present invention, when a cleaning failure has occurred and requires replacement. (The ease of replacement of the cleaning subsystem of the present invention allows the customer minimal down time to replace a failed cleaning unit.)

With continued reference to FIG. 3, the retractable blade 120 is retracted away from the photoreceptor surface. The door handle 175 is shown engaged with the frame of the xerographic module and enclosed in the locking mechanism (see exploded view of 175 in FIG. 2). The locking mechanism holds the door handle 175 as the cleaner subsystem 92 is slidably disengaged from the xerographic module. (The failed cleaner would be self-sealing once removed from the xerographic area. The cleaning subsystem is attached and detached from the xerographic apparatus by the rail guide 180.) As the cleaner subsystem 92 is slidably removed from the xerographic module, the door panel 170 is pulled closed along a track guide because the door handle 175 is held fixed. The residual particles 102 are sealed in the housing as the door 170 is pulled closed. When the door 170 is closed, the locking mechanism releases the door handle 175 and the cleaner subsystem 92 is removed from the printer machine. Thus, in the present invention, as the cleaner subsystem is removed, the door panel 170 closes, sealing the residual particles in the housing 160 to avoid residual particles spillage.

The replacement of the failed cleaning subsystem, as just described, is simple and can be handled easily by the customer. A spare replaceable cleaner unit is readily available in the event of failure of the cleaning subsystem while it is in place. The failed cleaning unit would be stored until a service representative is contacted. In this manner, the customer has minimal downtime.

Reference is now made to FIG. 4, which shows a perspective view of the cleaner subsystem with the door panel closed. With the door panel 170 closed, the cleaner subsystem can be removed form the xerographic apparatus without spillage of toner and other debris particles.

Reference is now made to FIG. 5, which shows a top partial breakaway view of the collection of the door panel, when the door panel is open. The door panel 170 is made of a thin flexible material (e.g. mylar) supported by vertical support rods 185 (e.g. metal or plastic). The vertical support rods 185 are strategically placed throughout the door panel 170 to strengthen the door panel. When the door panel 170 is open, the door panel 170collects in the wider part of the track 181 to allow the folds of the door 170 to collect therein.

In recapitulation, the present invention is a customer replaceable cleaning unit with a self-sealing door that prevents toner and other debris spillage when the unit is removed from the printer machine. The cleaning system is a hybrid of a disturber brush and a retractable cleaning blade, The cleaning unit is slidably inserted or removed from the printer machine. The cleaning unit is removed from the machine when a cleaning failure occurs and replaced by a readily available spare cleaning unit. When the cleaning unit is inserted into the printer machine, the door panel is opened as the cleaning unit is moved into the appropriate space. The blade is moved into an engaged position with the photoreceptor for cleaning. When the cleaning unit is removed from the printer machine, the blade is retracted and the door panel is slidably closed as the cleaning unit is being removed, providing self-sealing of the cleaner unit and preventing toner and other debris spillage.

It is, therefore, apparent that there has been provided in accordance with the present invention, a hybrid cleaner that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. A printing apparatus having a cleaner subsystem for removing particles from a surface, comprising:

means for cleaning the particles from the surface;

a housing defining an open ended chamber, said cleaning means being mounted in the chamber of said housing with a portion thereof being adapted to extend from the open ended chamber into contact with the surface; and a cover mounted movably on said housing and being adapted to move between a position closing the open ended chamber to a position opening the open ended chamber in response to the cleaner subsystem being inserted into the printing apparatus.

2. An apparatus as recited in claim 1, wherein said cover moves from the position opening the open ended chamber to the position closing the open ended chamber in response to the cleaner subsystem being removed from the printing apparatus to prevent spillage of particles from the chamber of said housing.

3. An apparatus as recited in claim 2, further comprising:

means for disturbing residual particles on the surface; and an auger located in the chamber of said housing for transporting the particles therefrom.

4. An apparatus as recited in claim 1, wherein said cover comprises a flexible member.

5. An apparatus as recited in claim 1, wherein said cover comprises:

a panel;

means for slidably supporting said panel in said housing; and a handle mounted on said panel.

6. An apparatus as recited in claim 3, wherein said disturbing means comprises a brush.

7. An apparatus as recited in claim 3, wherein said cleaning means comprises a blade.

8. An apparatus as recited in claim 7, wherein said blade is movable between a position extending from the open ended chamber to a position retracted into the chamber of said housing.

9. An apparatus as recited in claim 5, further comprising means for slidably supporting the cleaner subsystem in the printing apparatus.

10. An apparatus as recited in claim 9, wherein said handle contacts a portion of the printing apparatus upon the cleaner subsystem being inserted into the printing apparatus sliding said panel to open the open ended chamber.

11. An apparatus as recited in claim 9, wherein said handle contacts a portion of the printing apparatus upon the cleaner subsystem being removed from the printing apparatus sliding said panel to close the open ended chamber.

12. A method of installing a cleaner subsystem adjacent to a surface of a printing machine, comprising the steps of:

inserting the cleaner subsystem into the printing machine; and opening a chamber of the cleaner subsystem, in response to the cleaner subsystem being inserted into the printing machine, to enable a cleaning member to extend from the chamber into contact with the surface.

13. A method according to claim 12, further comprising the steps of:

collecting the particles removed from the surface in the chamber of the cleaner subsystem;

removing the cleaner subsystem from the printing machine; and closing the chamber of the cleaner subsystem, in response to the cleaner subsystem being removed from the printing machine, to prevent spillage of the chamber of the particles.

14. A method as recited in claim 13, further comprising the step of camming a cleaning blade into contact with the surface in response to the chamber of the cleaner subsystem being opened.

15. A method as recited in claim 13, wherein said step of closing the chamber of the cleaner subsystem comprises the step of camming a cleaning blade out of contact with the surface.

16. An operator replaceable cleaning unit adapted to remove particles from a surface of a printing machine, comprising:

a device for cleaning the particles from the surface;

a housing defining an open ended chamber, said cleaning device being mounted in the chamber of said housing with a portion thereof being adapted to extend from the open ended chamber into contact with the surface; and a cover mounted movably on said housing and being adapted to move between a position closing the open ended chamber to a position opening the open ended chamber in response to the cleaning unit being inserted into the printing machine.

17. A cleaning unit as recited in claim 16, wherein said cover moves from the position opening the open ended chamber to the position closing the open ended chamber in response to the cleaning unit being removed from the printing machine to prevent spillage of particles from the chamber of said housing.

18. A cleaning unit as recited in claim 17, further comprising:

a device for disturbing residual particles on the surface; and an auger located in the chamber of said housing for transporting the particles therefrom.

19. A cleaning unit as recited in claim 16, wherein said cover comprises a flexible member.

20. A cleaning unit as recited in claim 16, wherein said cover comprises:

a panel;

a device for slidably supporting said panel in said housing; and a handle mounted on said panel.

21. A cleaning unit as recited in claim 18, wherein said disturbing device comprises a brush.

22. A cleaning unit as recited in claim 18, wherein said cleaning device comprises a blade.

23. A cleaning unit as recited in claim 22, wherein said blade is movable between a position extending from the open ended chamber to a position retracted into the chamber of said housing.

24. A cleaning unit recited in claim 20, further comprising a device for slidably supporting the cleaning unit in the printing machine.

25. A cleaning unit as recited in claim 24, wherein said handle contacts a portion of the printing machine upon the cleaning unit being inserted into the printing machine sliding said panel to open the opened chamber.

26. A cleaning unit as recited in claim 25, wherein said handle contacts a portion of the printing machine upon the cleaning unit being removed from the printing machine sliding said panel to close the open ended chamber.

* * * * *